United States Patent [19]

Middleton

[11] 4,281,577

[45] Aug. 4, 1981

[54] ELECTRONIC TUNING DEVICE

[76] Inventor: Peter Middleton, Box 255, DeKalb, Ill. 60115

[21] Appl. No.: 40,558

[22] Filed: May 21, 1979

[51] Int. Cl.[3] ..... G10G 7/02

[52] U.S. Cl. ..... 84/454; 84/DIG. 18; 324/79 D

[58] Field of Search ..... 84/454, 1.01, DIG. 18; 324/78 Q, 78 Z, 79 R, 79 P; 340/146.2, 149 R, 171 R, 177 CA; 364/484

[56] References Cited

U.S. PATENT DOCUMENTS

| | | | |
|---|---|---|---|
| 3,795,169 | 3/1974 | Belcher | 324/78 Z |
| 3,952,625 | 4/1976 | Peterson | 84/454 |
| 4,120,229 | 10/1978 | Ota | 84/454 |
| 4,123,704 | 10/1978 | Johnson | 324/78 Z |

*Primary Examiner*—L. T. Hix
*Assistant Examiner*—Stafford D. Schreyer
*Attorney, Agent, or Firm*—Fred L. Denson

[57] ABSTRACT

An electronic tuning device provides four different modes of operation. In a first mode, the device sounds one of a plurality of internally generated audio frequency pitch standards that is manually selected by an operator for audible comparison with a note played on the instrument to be tuned. In a second mode, the manually selected, internally generated frequency pitch standard is compared with the note played on the musical instrument to be tuned and any deviation in frequency is visually displayed by a beat frequency indicator. In a third mode, the device automatically tracks an incoming note played on the musical instrument, compares such note with the internally generated frequency pitch standards and sounds the pitch standard that is closest in frequency to the incoming note. In a fourth mode, the incoming musical note is automatically tracked, compared with the internally produced pitch standards and any deviation from the pitch standard closest in frequency is visually displayed by the beat frequency indicator.

6 Claims, 4 Drawing Figures

ELECTRONIC TUNING DEVICE

BACKGROUND OF THE INVENTION

1. Field of the Invention

This invention relates to a tuning device for a musical instrument. More particularly, the invention relates to an electronic tuning device having solid state components.

2. Description of the Prior Art

In a number of existing electronic tuning aids, a musician manually selects one of a number of internally generated audio frequency pitch standards for audible comparison with the instrument to be tuned. Other existing electronic tuning aids provide a visual comparison, via a strobe wheel, zero center meter or other visual readout device, between an internally generated reference pitch and the pitch of a musical note played by a musician and picked up by a microphone of the tuning aid. An improved electronic tuning aid that can operate alternatively or simultaneously in the audio and visual modes is disclosed in U.S. Pat. No. 3,952,625 to Peterson. The Peterson device, however, has a number of disadvantages which limit its usefulness. One disadvantage is that a particular pitch must be manually selected by means of a rotary switch on the tuning device. This precludes playing a series of unison pitches without the intrusion of unwanted intermediate pitches as the switch is rotated to the next desired pitch. Another disadvantage of the Peterson device is that is has only manual modes of operation, that is to say in both the audio and visual formats the user must manually set the rotary switch to each different pitch to which the instrument is to be tuned. This procedure is both time consuming and subject to occasional error.

SUMMARY OF THE INVENTION

Accordingly, it is one object of the invention to provide an improved tuning device which allows the user to move between any two pitches in the range of the tuning device without sounding or visually comparing unwanted intermediate pitches.

Another object of the invention is to provide a tuning aid that automatically tracks a musical note supplied thereto by a musical instrument and either sounds an internally generated reference pitch that is closest in frequency to the incoming musical note or alternatively visually displays any deviation of the tracked input note with the selected closest internally generated reference pitch.

These and other objects of the invention are achieved in accordance with the teachings of the present invention by a tuning device having a plurality of touch switches which allows the user to select any one of the pitches within the tuning device's range and to move between any two pitches without the intrusion of unwanted intermediate pitches. The selected pitch is sounded through an internal loudspeaker or alternatively such pitch is compared with an incoming note produced by a musical instrument and any deviation in frequency is visually displayed on a panel. In a preferred embodiment the tuning device has the capability of tracking an incoming note and comparing such note with reference pitches internally produced by a pitch generator. The internally generated reference pitch that is closest in frequency to the incoming note is then sounded after a delay of a few milliseconds. Alternatively, the incoming note is compared with the closest internally generated reference pitch and any deviation therefrom is visually displayed on the panel. The two (audio/visual) manual modes of operation and the two (audio/visual) automatic tracking modes of operation of the tuning device provide the user thereof with versatility that is advantageous to both student and professional musicians.

The invention and its objects and advantages will become more apparent by referring to the accompanying drawings, wherein like reference numerals denote like parts, and to the ensuing detailed description of the preferred embodiment which follows.

DETAILED DESCRIPTION OF THE PREFERRED EMBODIMENT

Figure 2:
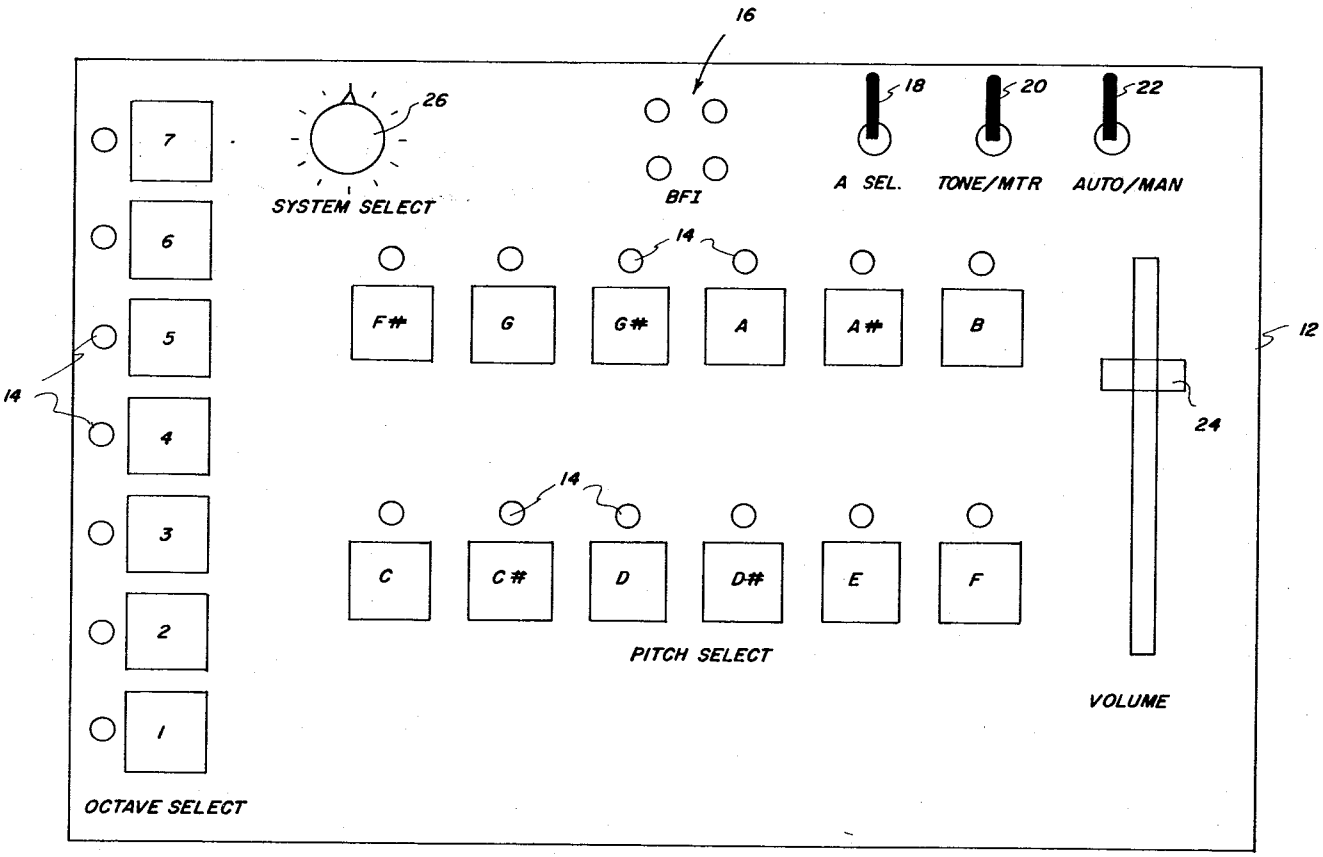
FIG. 2 is a front elevational view of the control panel for the tuning device of FIG. 1.

With reference now to the drawings, a tuning device 10, constructed in accordance with the teachings of the present invention, is provided with a plurality of circuit boards on which are mounted the various components which make up the device. On a front cover panel 12 shown in FIG. 2, there are mounted twelve pitch select touch switches, designated F#, G, G#, A, A#, B, C, C#, D, D#, E and F, respectively, and seven octave select touch switches designated 1, 2, 3, 4, 5, 6 and 7, respectively. A light emitting diode (LED) 14 is mounted adjacent to each one of the aforementioned touch switches. When the user of the tuning device 10 activates a particular pitch select switch and a particular octave select switch, he is informed of his choices by the illumination of the associated LEDs 14. Also mounted on the front panel 12 are a beat frequency indicator 16, an A frequency select switch 18, a tone/meter select switch 20, an auto/manual select switch 22, a volume control 24, and a rotary, twelve position tuning system select switch 26. The twelve different tuning systems provided by the switch 26 are Equal Temperament, Equal Temperament with three types of stretch, Werckmeister III, Kirnberger III, Silberman 1/6 comma, Van Biezen ¼ meantime, Pythagorean, Just (Lloyd) and Rameau modified ¼ comma. Of course, other tuning systems can be substituted for or added to the foregoing list with appropriate memory expansion.

Figure 1:
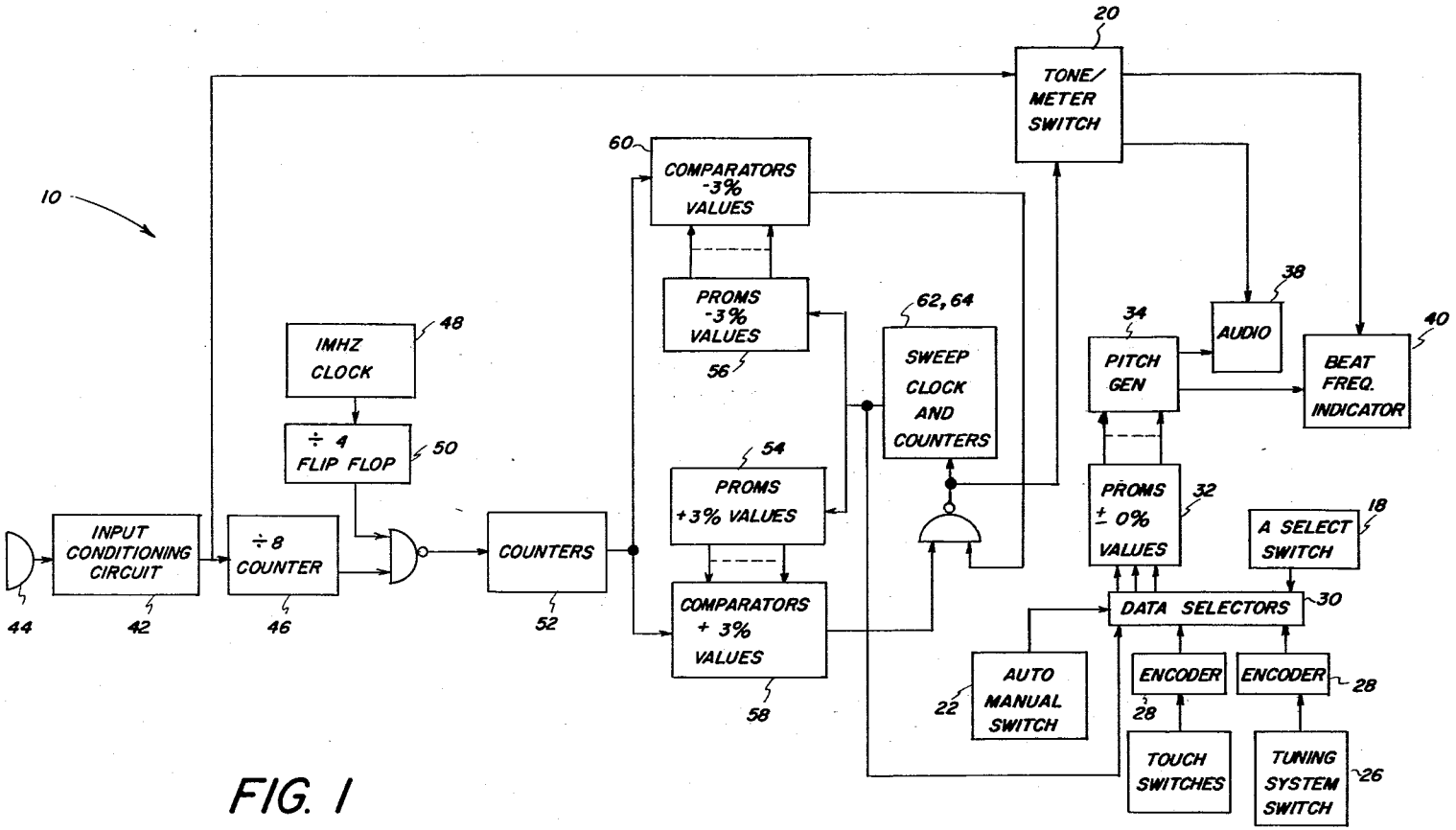
FIG. 1 is a block diagram of a tuning device constructed in accordance with a preferred embodiment of the invention.

As shown in FIG. 1, the pitch select, octave select and tuning system select switches are coupled to encoders 28 which provide binary data signals through data selectors 30 to programmable read-only memories (PROMS) 32 which constitute storage devices for a catalog of divisors representing information about the various pitches, octaves and tuning systems of the device 10. The data selectors 30 address the PROMS 32 to selectively retrieve and apply data to a pitch generator 34, comprising a 40 MHz oscillator (not shown) and a 20 bit divider chain and a plurality of frequency dividers (not shown). The audio frequency selectively derived from the pitch generator 34 is delivered to a utilization circuit which can be either an audio amplifier circuit 38 or a beat frequency indicator circuit 40, both of which are known in the art and need not be described in detail.

In one manual mode of operation of the tuning device 10, the auto/manual select switch 22 is set in the manual position, the tone/meter select switch 20 is set in the tone position and the A select switch 18 is set to either 440 Hz or 442 Hz which sets the frequency of the "A" pitch and thereby of all the other pitches. The appropriate tuning system is selected by turning the rotary switch 26 and a particular pitch within that tuning system is selected by touching one pitch select switch and one octave select switch. The selected pitch then sounds through the audio circuit 38 for audible comparison with a note played on the musical instrument to be tuned.

In a second manual mode of operation of the tuning device 10, the tone/meter switch 20 is set in the meter position and the auto/manual select switch 22, A select switch 18, tuning system select switch 26, pitch select and octave select switches are set in the same manner as previously described. The selected reference pitch internally generated by the pitch generator 34 is applied to the beat frequency indicator circuit 40 which includes the display panel arrangement 16 of four LEDs on the panel 12. The beat frequency indicator circuit 40 also receives a signal from a conditioning circuit 42 whose structure and operation are well known in the art. The conditioning circuit 42 recovers and shapes the fundamental frequency of an input note or tone supplied by a musical instrument to an accoustical pick-up microphone 44. The beat frequency indicator circuit visually displays the difference in frequency between the two received signals by controlled energization of the four LEDs so that a dot of light appears to rotate clockwise or counterclockwise at a rate depending on the amount the input signal is higher to lower in frequency than the internal reference signal. When the tone produced by the musical instrument is in tune with the reference signal produced by the pitch generator 34, a stationary display is produced by LEDs of the beat frequency indicator circuit 40. The tuning device 10 of the present invention also has two automatic modes of operation, wherein an incoming note supplied through the microphone 44 is tracked by the circuitry shown in FIGS. 3 and 4 and the reference pitch internally generated by the pitch generator 34 which is closest in frequency thereto is selected. The selected internal reference pitch is then applied to the audio circuit 38 or, alternatively, any deviation in frequency of the tracked input note from the selected closest reference pitch is visually displayed by the beat frequency indicator 16.

Figure 3:
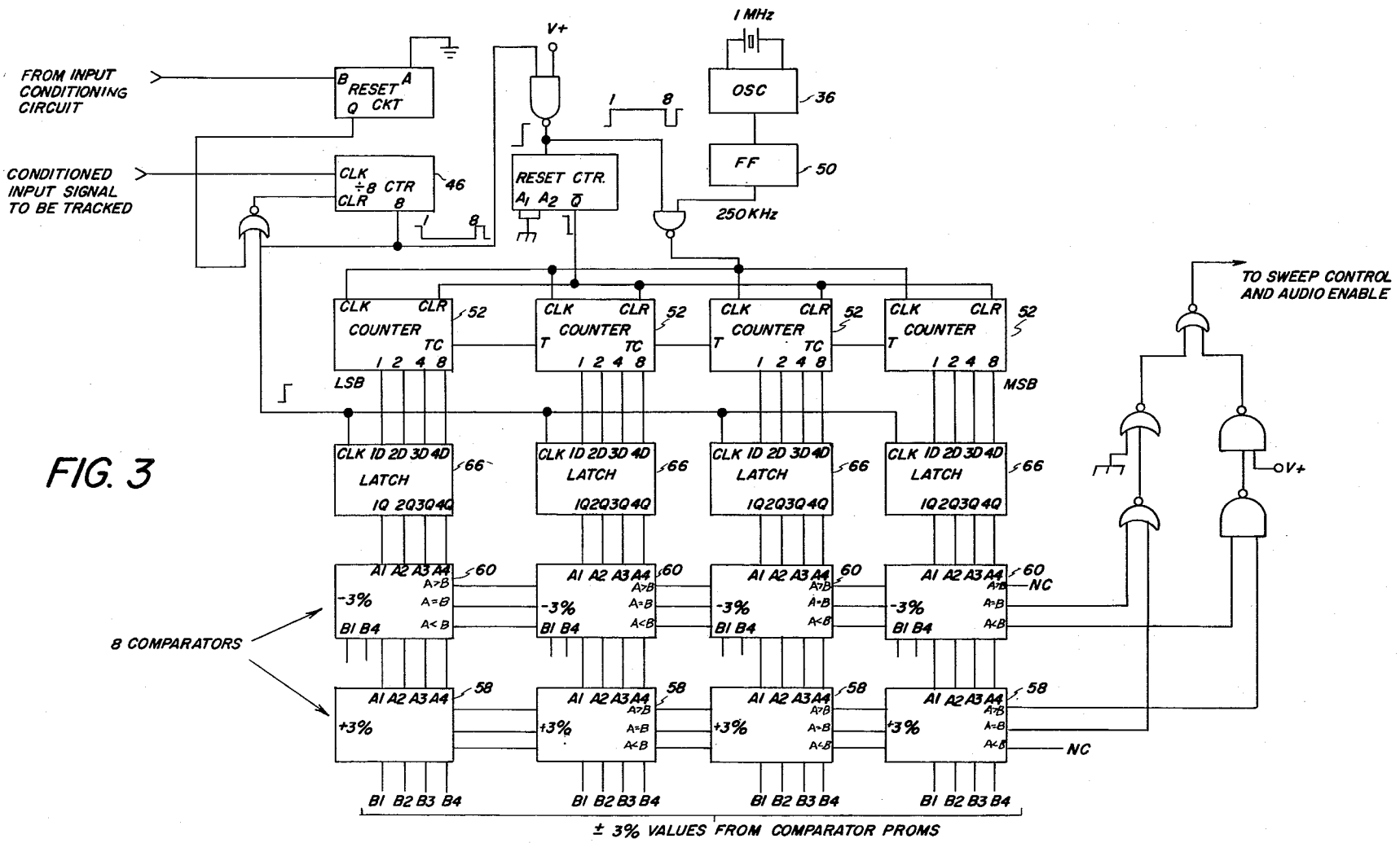
FIG. 3 is a schematic diagram of the circuit which compares a conditioned incoming signal with internally generated reference signals.
Figure 4:
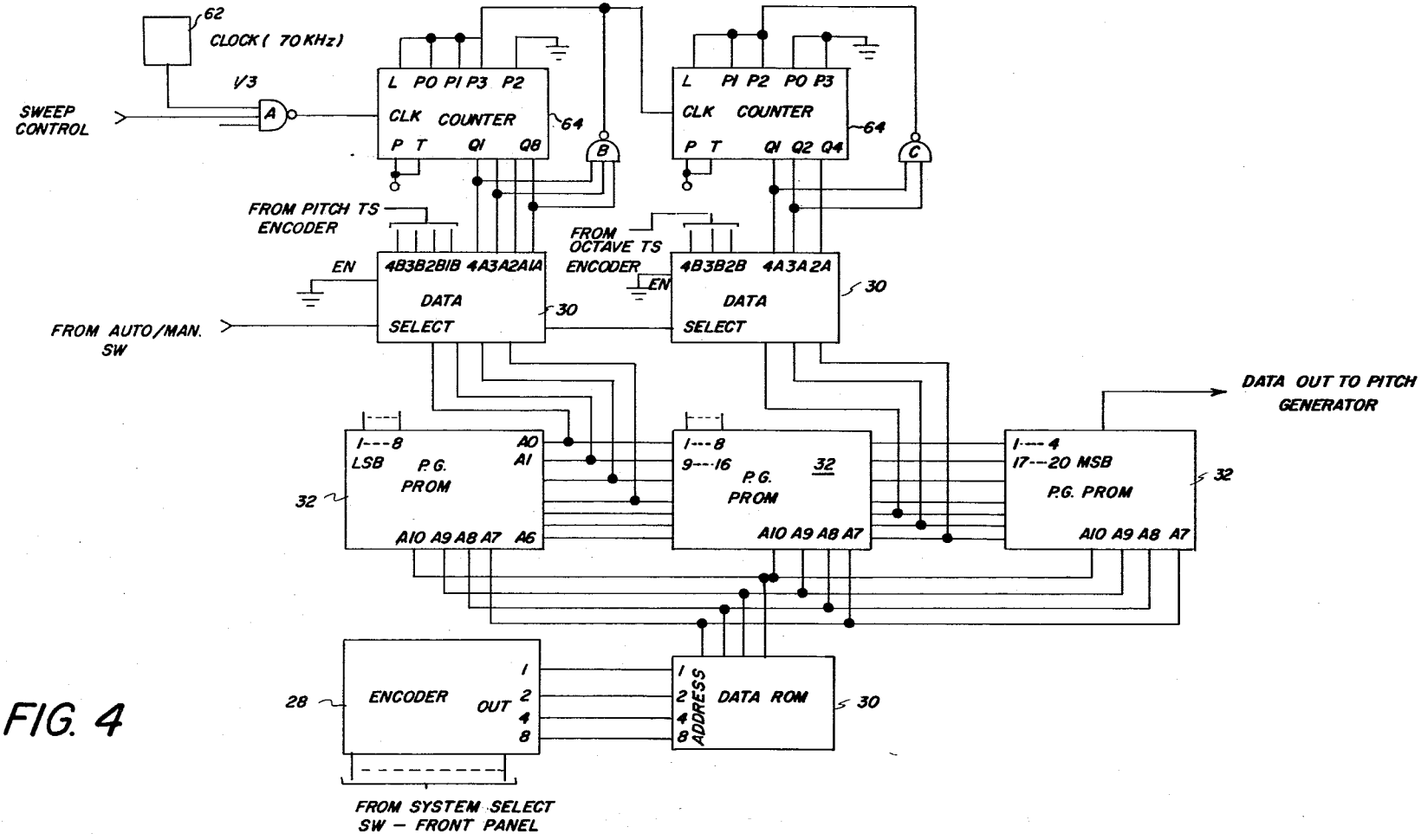
FIG. 4 is a schematic diagram of the circuit which simultaneously sweeps the memory devices that establish a window in the comparator circuit of FIG. 3.

As shown in FIG. 3, tracking is accomplished by applying the output signal from the conditioning circuit 42 to a divide by eight counter 46. While the divide by eight counter 46 is counting, a 250 Kilohertz signal derived from the one Megahertz crystal oscillator 36 and divided by a flip-flop 50 is gated into counters 52. The count in the counters 52 is thus proportional to eight cycles of the input signal. PROMS 54 and 56 having toward count values that correspond to +3% and −3%, respectively, of the frequencies derived from the pitch generator 34 establish a window in comparators 58 and 60. The +3% values establish a window having an opening of about ±48 cents or 48/100ths of a semitone. The comparator PROMS 54 and 56 and the pitch generator PROMS 32 are simultaneously addressed (swept) by a sweep clock 62 and counters 64 (see FIG. 4) from their lowest frequency values to their highest frequency values at a rate of approximately 70 kilohertz. The comparators 58 and 60 sequentially compare a series of two, 16 bit words supplied by latches 66 and PROMS 54 and 56. When the values in the comparators 58 and 60, which represent the frequency of the incoming signal from the conditioning circuit 42, are within the ±3% window, that is to say when the number in the comparators falls between the numbers stored in the ±3% PROMS 54 and 56, the sweep clock 62 is gated off and the selected utilization circuit is enabled. Since the pitch generator PROMS 32 are swept by the same clock and counters as the ±3% comparator PROMS 54 and 56, the ±0% values stored in the pitch generator PROMS 32 are always within the ±3% window. The worst case absolute pitch accuracy is 0.134 cents for any pitch produced by the tuning device in the automatic tracking mode. The worst case relative pitch error is 0.246 cents.

As previously noted, the tuning device 10 can utilize automatic tracking of the incoming musical note in either an audio or visual mode of operation. Thus, in one automatic mode of operation of the tuning device 10, the auto/manual select switch 22 is set in the automatic position, the tone/meter select switch 20 is set in the tone position, the A select switch 18 is set in either the 440 frequency or 442 frequency position and the tuning system select switch is set in the Equal Temperament position. It is to be understood, however, that automatic tracking can be provided with any of the available twelve tuning systems. A musical note or tone supplied by a musical instrument to the pick-up microphone 44 and processed by the conditioning circuit 42 is compared by the comparators 58 and 60 with the internally generated reference pitches produced by the pitch generator 34. The reference pitch that is within ±48 cents of the frequency of the output signal from the conditioning circuit 42 is then sounded by the audio circuit 38. The typical delay between input to the tuning device 10 and the reference output is approximately 100 milliseconds.

In the second automatic mode of operation of the tuning device 10, the tone/meter select switch 20 is set in the meter position and the auto/manual select switch 22, the A select switch 18, tuning select switch 26, pitch select switches and octave select switches are set in the manner described in the third mode of operation. A musical note or tone supplied by a musical instrument to the pick-up microphone 44 and processed by the conditioning circuit 42 is compared by the comparators 58 and 60 with the internally generated pitches produced by the pitch generator 34. The reference pitch that is within ±48 cents of the frequency of the output signal from the conditioning circuit 42 is selected. A signal representative of the selected pitches and the said output signal from the conditioning signal 42 are then applied to the beat frequency indicator circuit 40. The display diodes 16 of the beat frequency indicator circuit 40 are sequentially energized in one direction when the incoming note is sharp and are sequentially energized in the opposite direction when the tone is flat. When the instrument is in exact tune with the internally selected reference pitch, the display diodes will appear to be standing still.

The invention has been described in detail with reference to a preferred embodiment thereof but it will be understood that variations and modifications can be effected within the spirit and scope of the invention.

I claim:

1. A tuning device for tuning musical instruments comprising:

(a) pitch generator means for providing a series of audio frequencies that approximate the notes of a plurality of tuning systems over a range of at least one octave;

(b) a utilization circuit coupled to said pitch generator means;

(c) first memory means having addressable storage locations for storing a plurality of data signals representative of the audio frequencies produced by said pitch generator means;

(d) data selection means for addressing the storage locations of said first memory means to retrieve and apply data signals to said pitch generator means representative of only one of said tuning systems and only one of said audio frequencies in the selected tuning system, said data selection means being capable of applying data signals representative of the audio frequencies in the selected tuning system in any desired sequence;

(e) an accoustical pick-up microphone;

(f) an input conditioning circuit connected to said microphone for recovering the fundamental frequency of a note produced by a musical instrument and producing a data output signal representative thereof; and (g) signal tracking means including (a) sweep means for simultaneously addressing the storage locations of said first, second and third memory means, (2) comparator means for comparing the addressed data signals from said second and third memory means with the data output signal from said output conditioning circuit, and (3) gate means coupled to said comparator means for turning off said sweep means when the data output signal from said input conditioning circuit falls within the frequency range established by said second and third memory means, for applying the data signal from the last addressed storage location of said first memory means to said pitch generator means and for enabling said utilization circuit.

2. A tuning device according to claim 1 wherein said utilization circuit comprises audio amplifier means for audibly comparing audio frequencies produced by said pitch generator with a musical instrument to be tuned.

3. A tuning device according to claim 1 wherein said utilization circuit comprises a beat frequency indicator means for visually comparing audio frequencies produced by said pitch generator with a musical instrument to be tuned.

4. A tuning device according to claim 1 wherein said pitch generator means comprises an oscillator, a programmable 20 bit divider chain and a plurality of frequency dividers.

5. A tuning device according to claim 1 further comprising an auto/manual switch for selectively enabling and disabling said signal tracking means.

6. A tuning device according to claim 1 wherein said utilization circuit comprises audio amplifier means for audibly comparing audio frequencies produced by said pitch generator with a musical instrument to be tuned, beat frequency indicator means for visually comparing audio frequencies produced by said pitch generator with a musical instrument to be tuned, and an audio/-visual switch for selectively enabling one of said audio amplifier means and said beat frequency indicator means.

* * * * *